US005839165A

United States Patent [19]

Patelli et al.

[11] Patent Number: 5,839,165

[45] Date of Patent: Nov. 24, 1998

[54] TEXTILE MACHINE

[75] Inventors: Silvano Patelli; Antonio Cossandi; Giovanni Battista Pasini, all of Brescia, Italy

[73] Assignee: F.LLI Marzoli & C. S.p. A., Bergamo, Italy

[21] Appl. No.: 755,206

[22] Filed: Nov. 22, 1996

[30] Foreign Application Priority Data

Nov. 27, 1995 [IT] Italy ..... MI95A2473

[51] Int. Cl.[6] ..... D01H 5/00

[52] U.S. Cl. ..... 19/260; 19/236; 19/106 R

[58] Field of Search ..... 19/106 R, 236, 19/237, 238, 239, 256, 258, 260, 261, 286, 287, 294, 150, 296

[56] References Cited

U.S. PATENT DOCUMENTS

| | | | |
|---|---|---|---|
| 3,368,246 | 2/1968 | Bonalumi . | |
| 3,444,594 | 5/1969 | Whitehurst | 19/239 |
| 4,213,553 | 7/1980 | Leifeld | 19/106 R |
| 4,404,711 | 9/1983 | Klutterman . | |
| 4,501,048 | 2/1985 | Varga | 19/106 R |
| 5,274,883 | 1/1994 | Eke | 19/106 R |
| 5,619,773 | 4/1997 | Gohler et al. | 19/294 |

FOREIGN PATENT DOCUMENTS

| | | |
|---|---|---|
| 0643160 | 9/1994 | European Pat. Off. . |
| 60-155730 | 8/1985 | Japan . |
| 460050 | 9/1935 | United Kingdom . |
| WO/9502720 | 7/1994 | WIPO . |

*Primary Examiner*—Michael A. Neas
*Attorney, Agent, or Firm*—Diller, Ramik & Wight ,PC

[57] ABSTRACT

In order to control cotton fibre fluctuation between the compactor device (5) and the drafting unit (6) within a card (1A), the drafting unit (6) can be moved (either along a rectilinear trajectory and/or along a circular trajectory) between a first position (L) coinciding with its maximum distance from the compactor device (5) and a second position coinciding with its minimum distance from said compactor device (5) until said distance is reduced to the minimum possible. The distance between the drafting unit (6) and the compactor device (5) varies in a manner inversely proportional to the operating speed of the card (1A). In an alternative embodiment:

a support and guide element (40) for the web (9) is positioned between the doffer (2) and the pair of rollers (7, 8) of the compactor device (5);

a conveyor device (24) is interposed between the compactor device (5) and the drafting unit (6) (FIG. 2).

15 Claims, 9 Drawing Sheets

1C
3
7
5
19
14
19
34
35
16
17
6
4
9
20
10
15
11
18
8
2
29
30
31
H
32
30
33

TEXTILE MACHINE

BACKGROUND OF THE INVENTION

This invention relates textile machine.

During the process textile fibres and in particular cotton fibres by carders, the problem arises of controlling the fibre fluctuation which occurs in the processed product (web) mainly in the section between the compactor device and the drafting unit. A constant final product quality depends on constant fluctuation intensity.

The patents U.S. Pat. No. 3,925,850 and DE-A-36 17 525 describe devices which substantially suggest solving the aforesaid technical problem by measuring at the conveyor device (in the form of a funnel of fixed convergence) the density of the web produced by the card and on the basis of this density controlling the card operating parameters (roller rotational speed) to achieve the desired density.

The patents DE-A-27 32 016 and CH-A-575 479 describe devices which substantially suggest solving the aforesaid technical problem by providing downstream of the roller compactor device a conveyor device the convergence of which can be varied. The conveyor devices described in the two documents differ from each other mainly by the manner of forming the elements which enable the convergence to be varied.

Finally U.S. Pat. No. 5,018,248 suggests solving the aforesaid technical problem by measuring the thickness of the fibre sliver downstream of a conveyor device by a suitable device interposed between said conveyor device and the drafting device, and consequently acting on the operating parameters.

From the examined state of the art it can be essentially seen that:

- the existence of various technical solutions involving operating on said web when this lies between the conveyor device and the drafting device shows that the treatment and hence behaviour of the web fibres during passage from the doffer to the drafting device is very important for the final product quality;
- the technical problem has not yet been solved satisfactorily in all its aspects, and subsequently the currently proposed solutions are susceptible to improvement.

SUMMARY OF THE INVENTION

The object of the present invention is therefore to provide a textile machine, particularly but not exclusively for processing cotton, which is improved such as to solve the aforesaid problem in a particularly effective and hence satisfactory manner and which is also substantially economical.

The object is attained by a textile machine. The solution is new because in no document of the state of the art is it suggested to reduce to a minimum (and possibly to zero) the gap between the doffer and the drafting device as the operating speed of the machine is increased.

The solution is inventive because whereas all devices involve merely acting on the fibres within the gap between the conveyor device and the drafting device, the invention substantially reduces (possibly to zero) said gap on the basis of the operating speed, hence eliminating all fluctuation at its origin and consequently eliminating any problem occurring within said gap or in the web lying therein. The teaching on which the invention is based is therefore exactly contrary to that on which the aforesaid known art is based, because whereas this latter is directed to finding solutions based on better handling of said web portion, the invention essentially teaches to progressively reduce and possibly eliminate the web portion between the doffer and the drafting unit, and consequently the relative fibre fluctuation. The invention is illustrated by way of non-limiting example with reference to a cotton carder which currently appears to be the machine which mostly benefits from the invention, but without excluding its application to other fibres and to other textile machines provided with drafting devices such as drawing frames, spinning machines and the like.

BRIEF DESCRIPTION OF THE DRAWINGS

The invention is illustrated by way of non-limiting example in the figures of the accompanying drawings.

DESCRIPTION OF THE PREFERRED EMBODIMENTS

Figure 1:
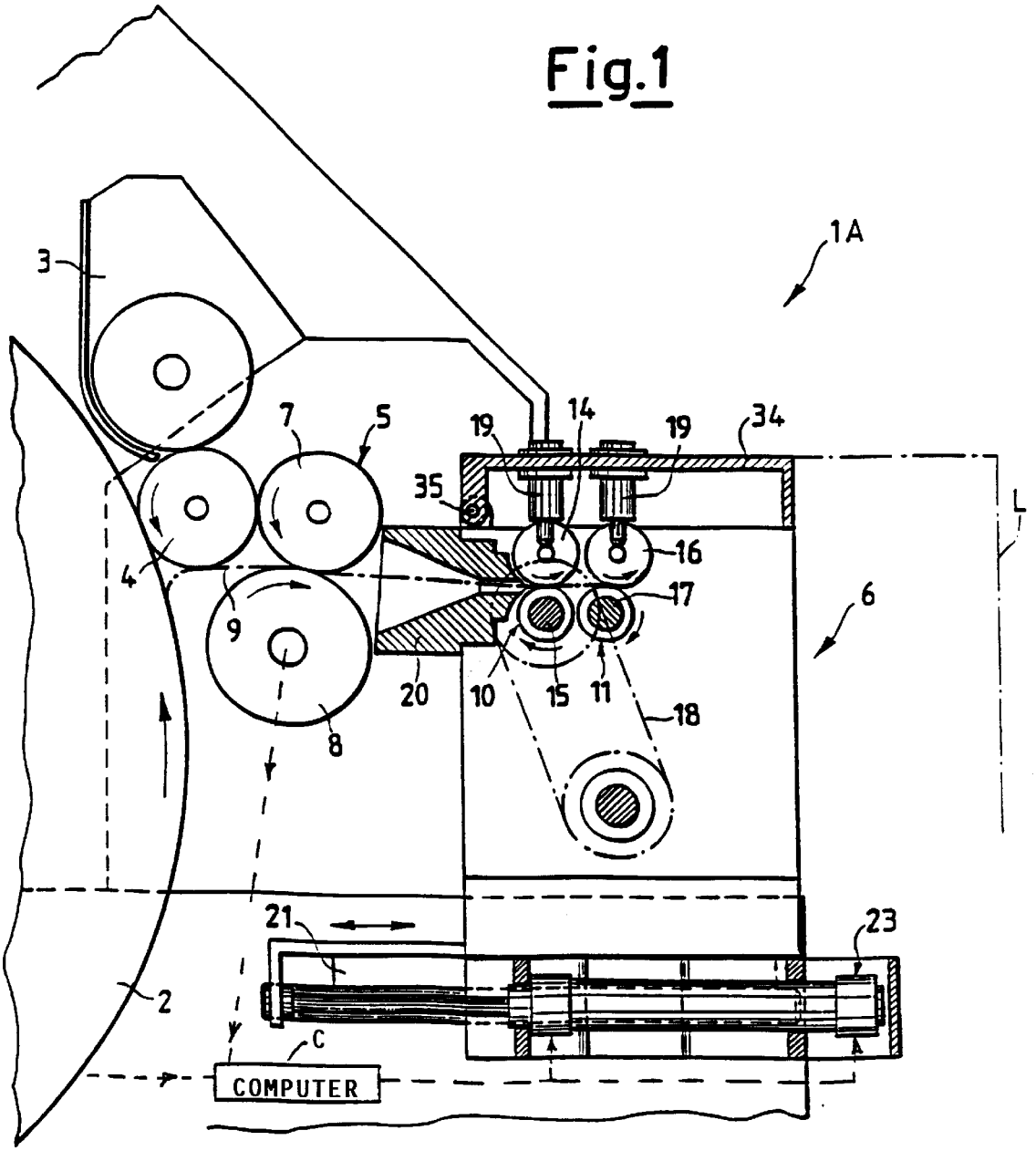
FIG. 1 is a schematic side view of a first embodiment of the textile machine according to the invention.
Figure 4:
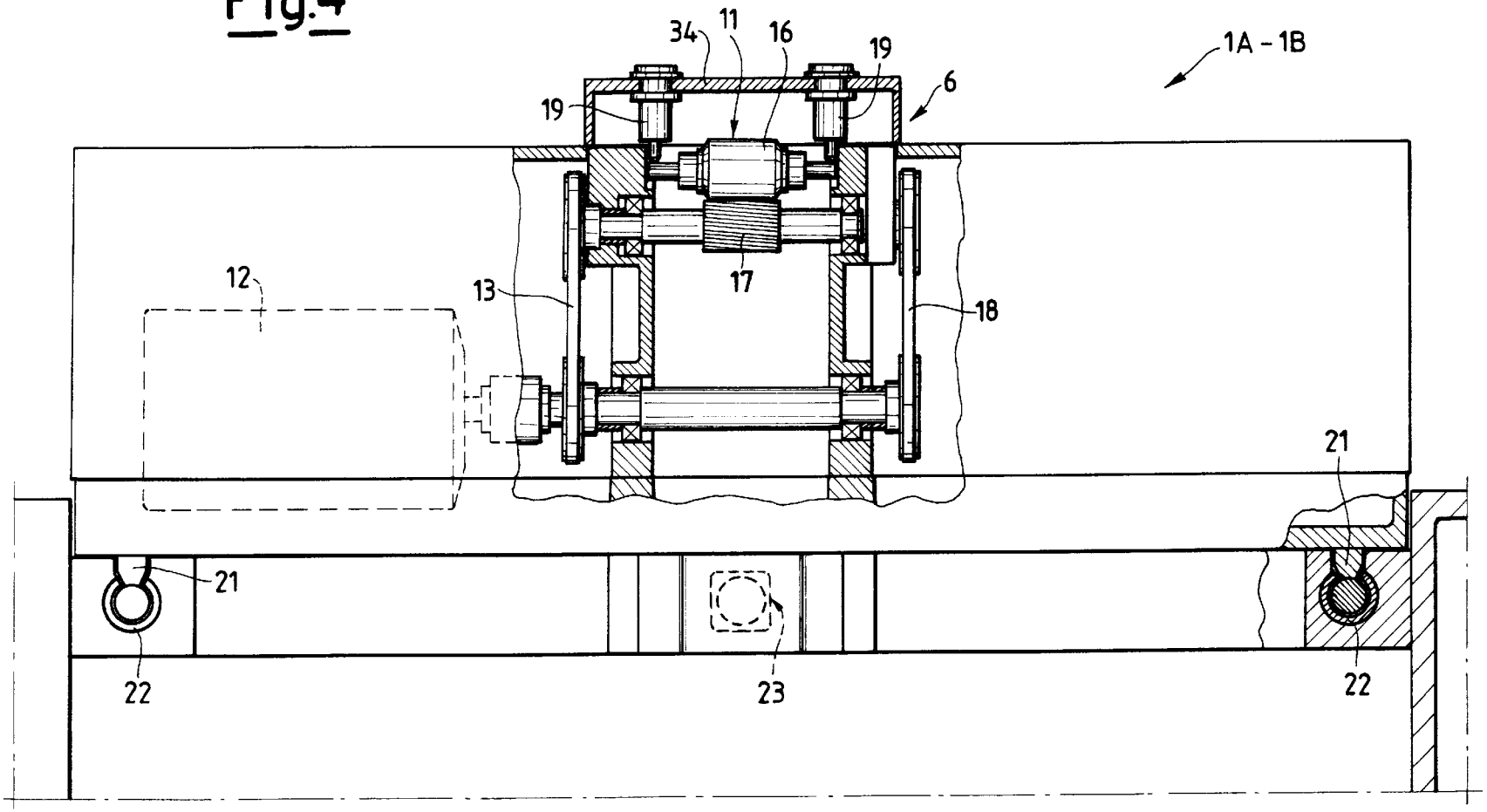
FIG. 4 is a frontal view of the first and second embodiments of the machine shown in FIGS. 1 and 2, illustrating a first method of driving the drafting unit.
Figure 5:
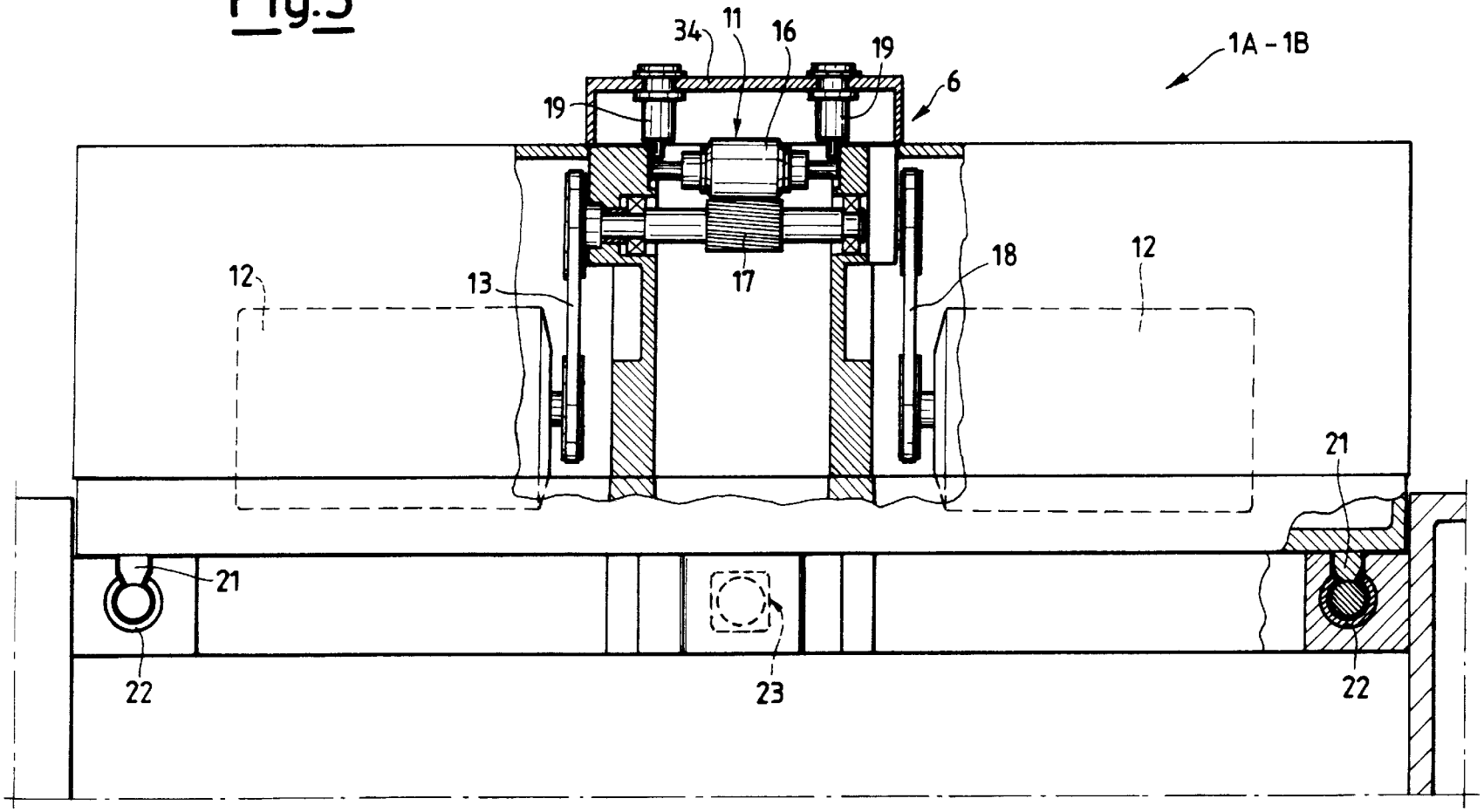
FIG. 5 is a frontal view of the first and second embodiments of the machine shown in FIGS. 1 and 2, illustrating a second method of driving the drafting unit.

With particular reference to FIGS. 1, 4 and 5, the textile machine of the invention, indicated overall by 1A, is a card for processing cotton fibres. It comprises a detachment roller 2, commonly known as a doffer roller, a brush device 3, a stripper roller 4, a compactor device 5 and a drafting device 6. The compactor device 5 comprises in the illustrated embodiment a first roller 7 and a second roller 8 of different diameters. The web 9 detached from the doffer roller 2 along its entire width by the stripper roller 4 passes between said rollers 7 and 8.

Figure 3:
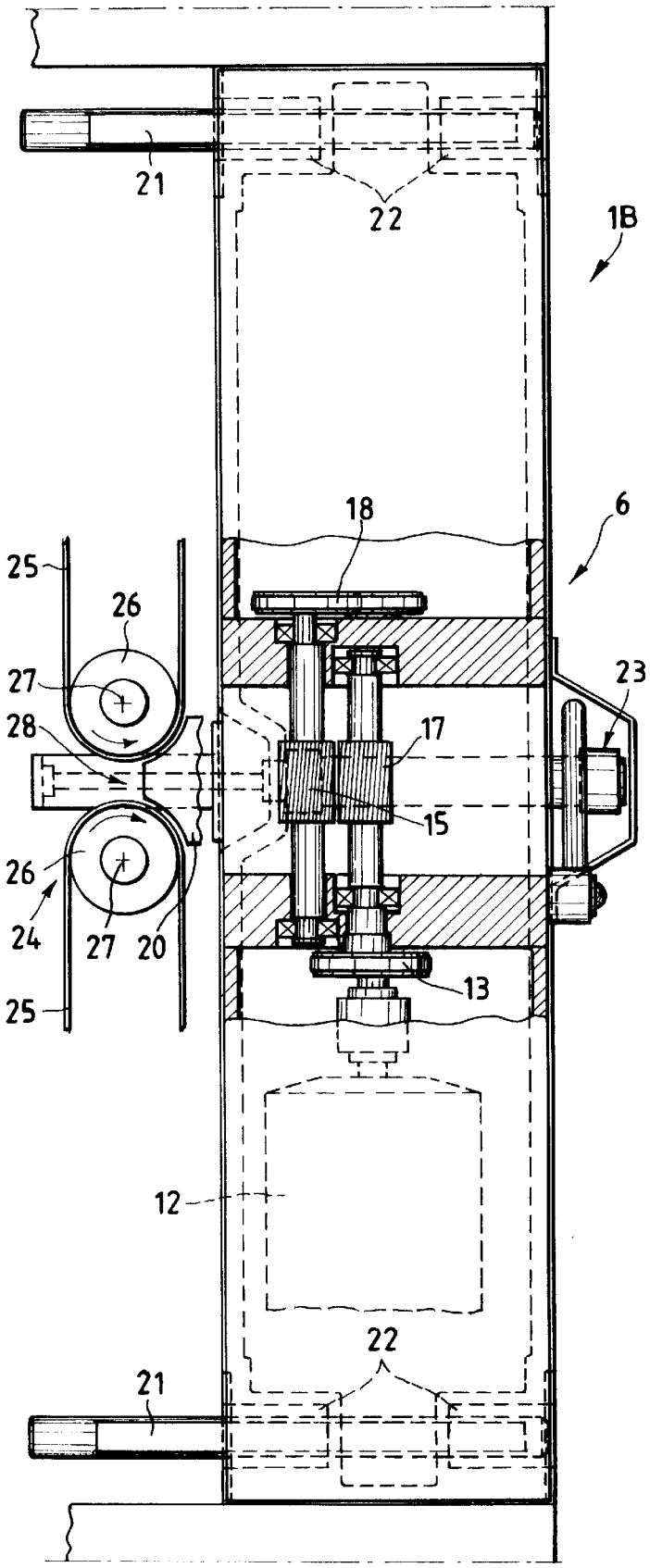
FIG. 3 is a plan view from above of the machine of FIG. 2.

The drafting device 6 comprises at least two pairs (a first 10 and a second 11) of superposed presser rollers, at least one of said pair being motorized by at least one electric motor 12. (FIG. 3) FIG. 4 shows the motor 12, which by means of the first belt 13 drives the lower roller 17 of the second pair 11, and by means of the second belt 18 drives the lower roller 15 of the first pair 10.

The lower rollers 15 and 17 of each pair are knurled parallel to their axes. The drafting device 6 comprises presser elements 19 (mounted on a cover 34 hinged at 35) acting elastically on the axles of the idle upper rollers 14 and 16 of each pair 10, 11, which are consequently pressed into contact with the motorized lower rollers 15, 17. The illustrated drafting device 6 also comprises an intake element 20 for the web 9 which is preferably in the form of a funnel. The drafting device 6 can be positioned between a first position of maximum withdrawal (indicated by the dashed and dotted line L in FIG. 1) and a second position of maximum approach (shown by full lines in FIG. 1) by translational movement along a trajectory which in the illustrated embodiment is rectilinear and parallel to the axis along which the web 9 moves between the compactor device 5 and the drafting unit 6.

The means for translationally moving the drafting device along a rectilinear trajectory comprise at least one pair of rectilinear guides 21 rigid with the drafting unit 6 and slidable, under the action of at least one hydraulic actuator 23, parallel to the axis of movement of the web 9 on bushes 22 (FIG. 3 and 4) fixed to the card frame. The movement means can be controlled by a computer (FIG. 1) on the basis of operating parameters well known to the expert of the art. Of these, the most important is the rotational speed of the textile machine rollers. Briefly, during the operation of the card 1A the drafting device 6 is positionable between a first position L coinciding with maximum distance from the compactor device and a second position coinciding with minimum distance from said compactor device 5, said second position possibly being such as to reduce said distance from the compactor device 5 to the minimum possible. The distance between the drafting device 6 and the compactor device 5 is varied in a manner inversely proportional mainly to the operating speed of the textile machine. This variation could also be decided on the basis of numerous other card operating parameters, not stated herein as they are well known to the expert of the art. In this latter case the positioning of the drafting device is particularly advantageous if also effected during machine operation, and could be made automatic if controlled by a computer (not shown). By operating in this manner the cotton fibre fluctuation between the compactor device 5 and the drafting unit 6 is controlled in an optimum manner during card operation, so eliminating the problems which could derive therefrom by virtue of the fact that the length of web between the device 5 and the drafting unit is so reduced (if not actually nullified) as to be of no influence. With particular reference to FIGS. 2, 3, 4 and 5, the textile machine of the invention, indicated overall by 1B, is a cotton fibre processing card which differs from that shown in FIG. 1 by the fact that between the compactor device 5 and the drafting unit 6 there is interposed a conveyor device 24 for the web 9. In the illustrated embodiment, the conveyor device 24 is of the type comprising at least two opposing annular belts 25 each of which moves about rollers 26 having their axis 27 incident or rather substantially perpendicular to the doffer roller 2. The annular belts 25 form an exit gap 28 for the web 9 which converges within said exit gap 28. The presence of the conveyor device 24 for the web 9 increases the effectiveness of the invention in that the fibres of the web 9 are better regularized and stabilized.

Figure 6:
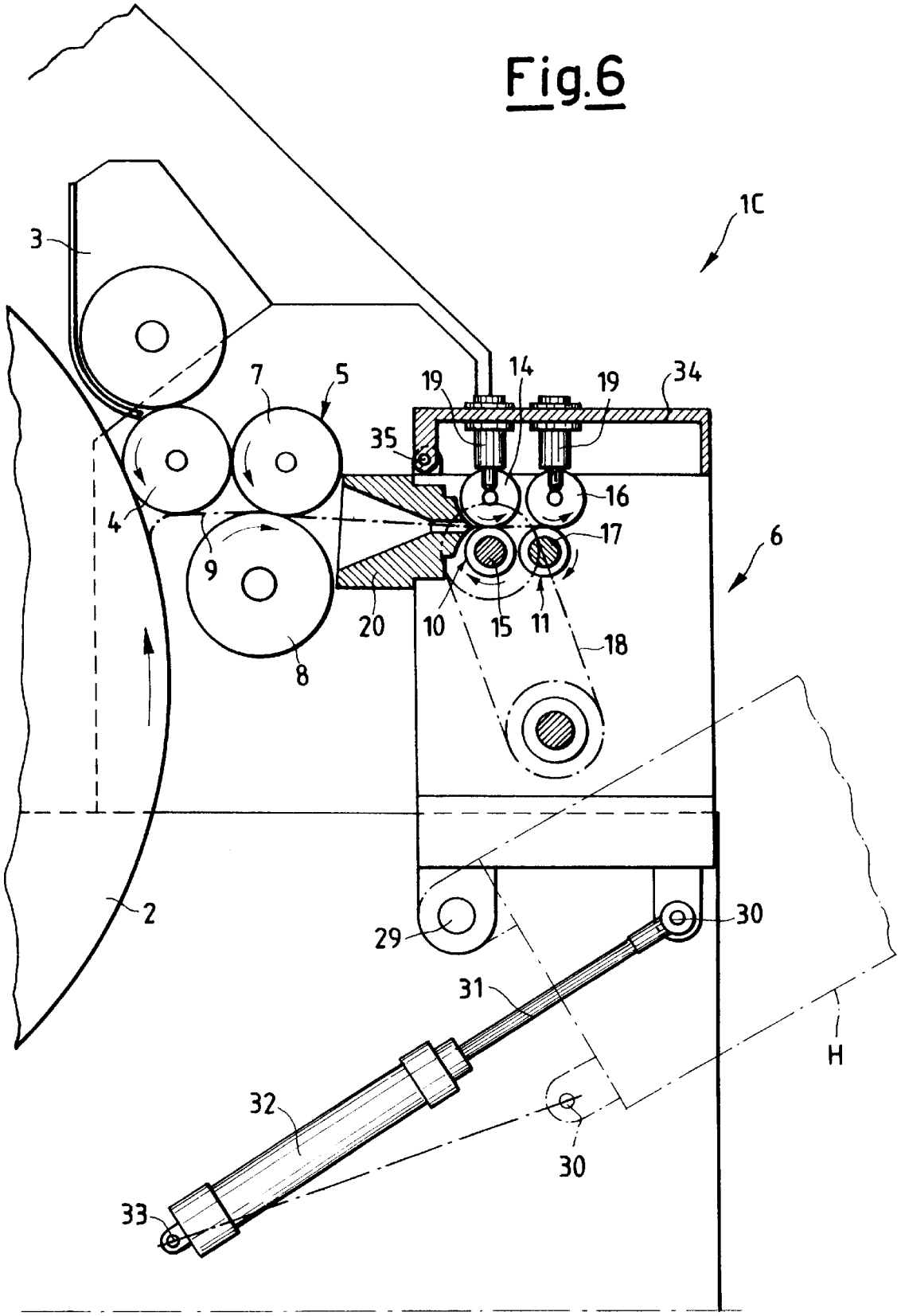
FIG. 6 is a schematic side view of a third embodiment of the textile machine according to the invention.
Figure 8:
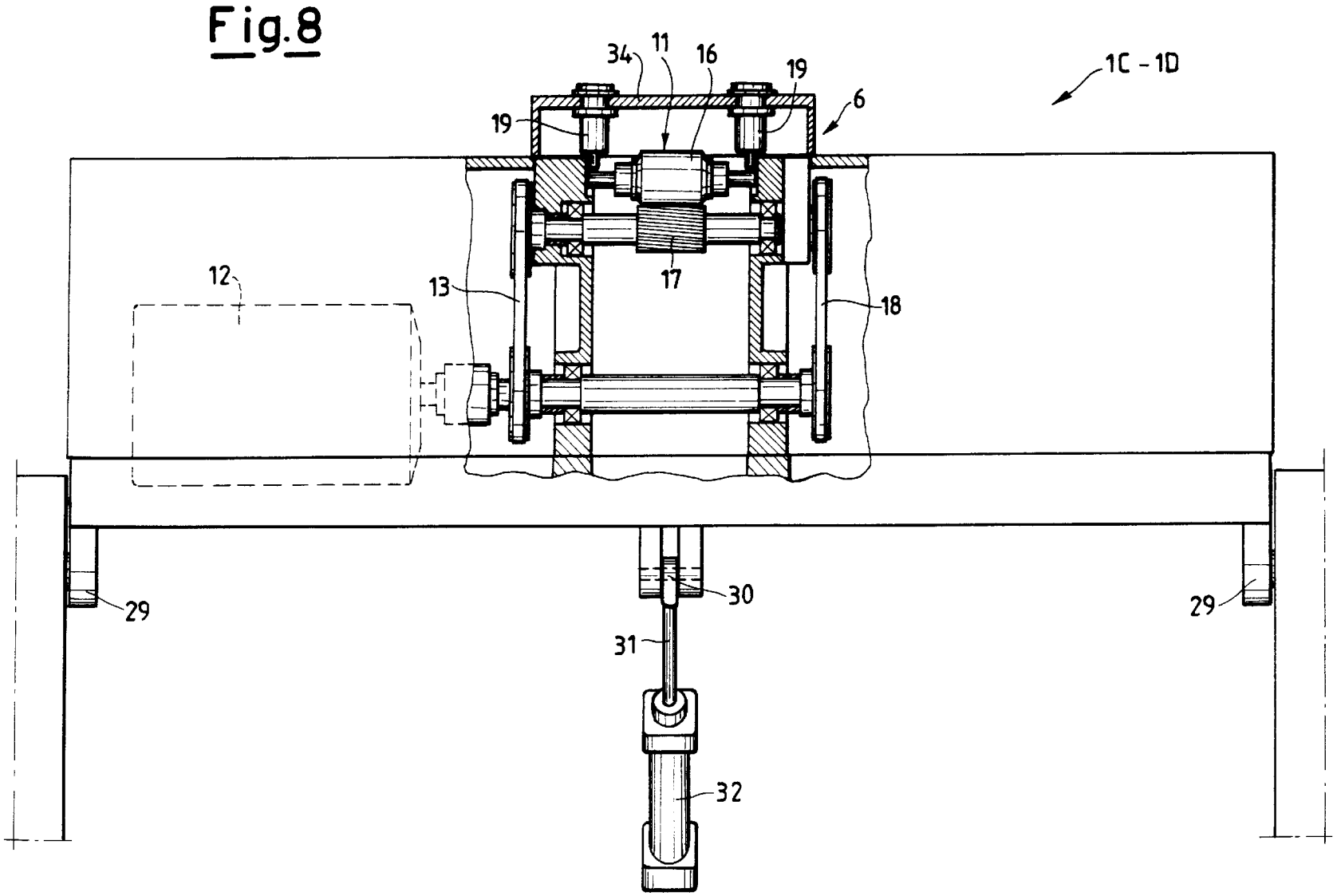
FIG. 8 is a frontal view of the third and fourth embodiments of the machine, shown in FIGS. 6 and 7.

With particular reference to FIGS. 6 and 8, the textile machine of the invention, indicated overall by 1C, is a cotton fibre processing card which differs from that shown in FIG. 1 by the fact that the drafting unit 6 is positionable between the first position H and the second position by moving along a circular trajectory.

It can be seen from the drawings that although of equal effectiveness its structure is simpler than that of the preceding embodiments.

The means for moving the drafting unit 6 along a circular trajectory comprise at least one first hinge 29 (a pair thereof in the illustrated embodiment) securing the drafting device 6 to the base of the machine 1C, at least one second hinge 30 securing the drafting unit 6 to the rod 31 of at least one second hydraulic actuator 32, and at least one third hinge 33 securing said second hydraulic actuator 32 to the base of the machine 1C.

Figure 7:
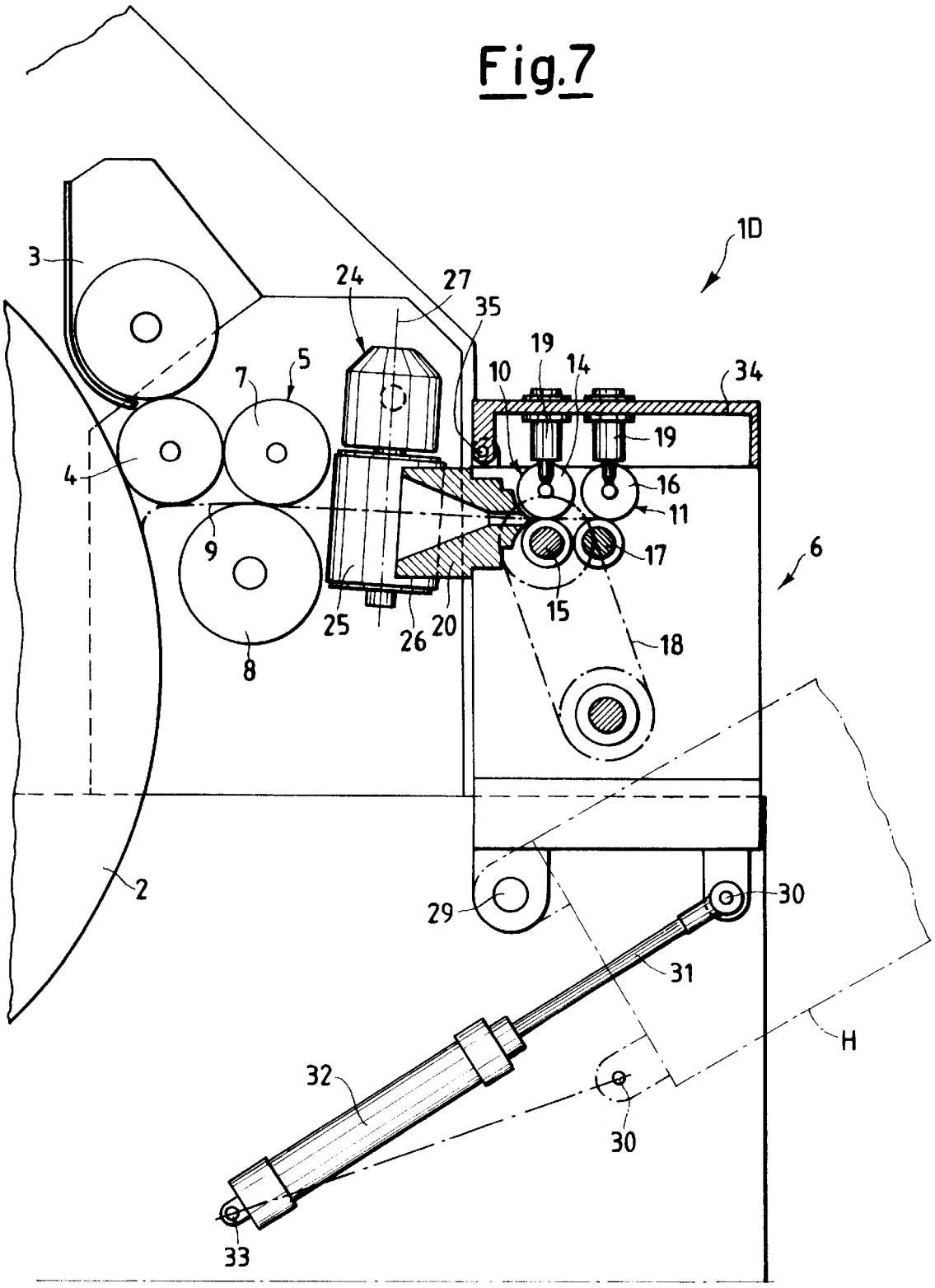
FIG. 7 is a schematic side view of a fourth embodiment of the textile machine according to the invention.

With particular reference to FIGS. 7 and 8, the textile machine of the invention, indicated overall by 1D, is a cotton fibre processing card which differs from that shown in FIG. 6 by the fact that between the compactor device 5 and the drafting unit 6 there is provided a conveyor device 24 for the web 9. Again in this case the conveyor device 24 is preferably of the type comprising at least two opposing annular belts 25 each of which moves about rollers 26 having their axis 27 substantially perpendicular to the doffer roller 2.

Figure 2:
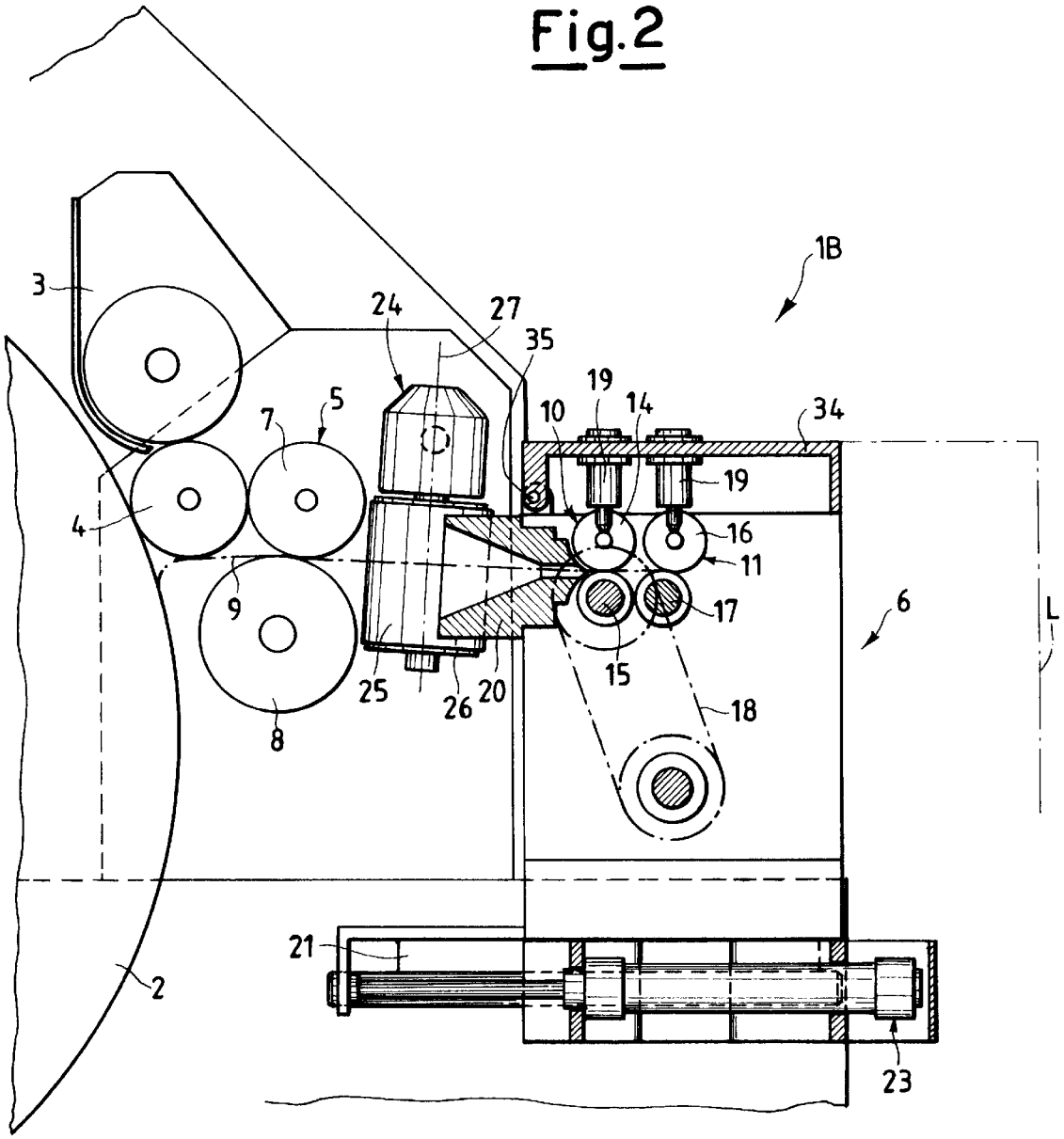
FIG. 2 is a schematic side view of a second embodiment of the textile machine according to the invention.

The web conveyor device 24 offers the advantages already indicated for the embodiment of FIG. 2.

Figure 9:
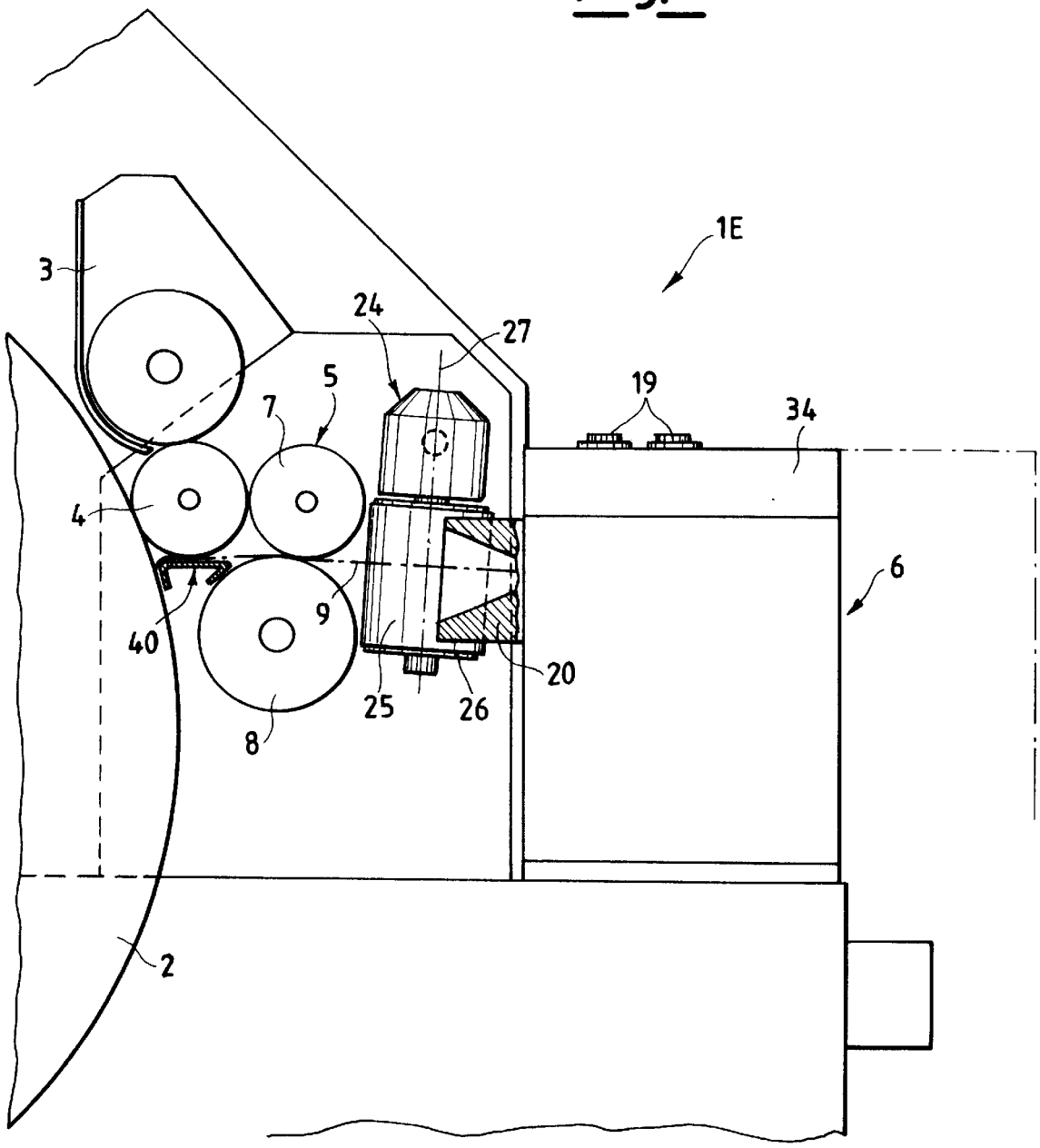
FIG. 9 is a schematic side view of a fifth embodiment of the textile machine according to the invention.

With particular reference to FIG. 9, according to the fifth embodiment, the machine of the invention, indicated overall by 1E, comprises between the doffer 2 and the pair of rollers 7 and 8 of the compactor device 5 a web support and guide element 40 which has given excellent experimental results. The support and guide element 40 extends substantially along the entire width of the doffer roller 2 and stripper roller 4. FIG. 9 clearly shows the cross-sectional shape of the support and guide element 40 and its position relative to said doffer roller 2 and stripper roller 4. The support and guide element 40 is applicable to any of the textile machines of the present invention.

In a sixth embodiment of the textile machine (not shown), the drafting unit 6 moves along a trajectory obtained by combining a rectilinear translational movement with a barycentric rotation.

Although a preferred embodiment of the invention has been specifically illustrated and described herein, it is to be understood that minor variations may be made in the apparatus without departing from the spirit and scope of the invention, as defined the appended claims.

We claim:

1. A textile machine (1A–1E) comprising a doffer (2) and a drafting unit (6), said drafting unit (6) being positioned downstream of said doffer (2) with respect to the direction of travel of a fibre web (9) at the operating speed of the textile machine (lA-lE), means (21–23; 29–33) for effecting movement of the drafting unit (6) between a first position (L) coinciding with the maximum distance of the drafting unit (6) from the doffer (2) and a second position coinciding with the minimum distance of the drafting unit (6) from the doffer (2), and means (C) for varying the distance between the drafting unit (6) and the doffer (2) inversely proportional to the operating speed of the textile machine (1A–1E).

2. The textile machine as defined in claim 1 including a support and guide element (40) for the fibre web (9) positioned between the doffer (2) and a pair of rollers (7, 8) of a compactor device (5).

3. The textile machine as defined in claim 1 wherein the drafting unit (6) is positioned between the first position (L) and the second position by translational movement along a rectilinear path.

4. The textile machine as defined in claim 3 wherein the means (21–23; 29–33) for effecting translational movement of the drafting unit (6) along the rectilinear path includes at least one pair of rectilinear guides (21) of the drafting unit (6) slidable parallel to the direction of fibre web advancement on bushes under the effect of a hydraulic actuator (23).

5. The textile machine as defined in claim 1 wherein the drafting device (6) is positionable between the first position (L) and the second position by translational movement along a circular path.

6. The textile machine as defined in claim 5 wherein the means (21–23; 29–33) for effecting translational movement of the drafting unit (6) along the circular path includes a first hinge (29) securing the drafting unit (6) to a machine base, a second hinge (30) securing the drafting unit (6) to a rod (31) of a second hydraulic actuator (32), and a third hinge (33) securing said second hydraulic actuator (32) to the machine base.

7. The textile machine as defined in claim 3 wherein the drafting unit (6) can be positioned during machine operation, and said distance varying means includes a computer (C).

8. The textile machine as defined in claim 1 including a web conveyor device (24) and a compactor device (5) between the doffer (2) and the drafting unit (6), and the web conveyor device (24) includes at least two opposing annular belts (25) entrained about rollers (26) having their axes (27) incident to the doffer (2) with convergent movement within an exit gap (28).

9. The textile machine as defined in claim 1 wherein the textile machine is a cotton processing card.

10. The textile machine as defined in claim 1 wherein the drafting unit (6) includes at least two pairs (10, 11) of superposed presser rollers (14–17), and at least one of said pairs (10, 11) being driven by an electric motor (12).

11. The textile machine as defined in claim 10 wherein lower rollers (15, 17) of each pair (10, 11) are knurled parallel to their axes.

12. The textile machine as defined in claim 10 wherein the drafting unit (6) includes presser elements (19) acting elastically upon axles of upper idle rollers (14, 16) of each pair (10, 11) which are consequently pressed elastically into contact with the lower rollers (15, 17).

13. The textile machine as defined in claim 10 wherein the drafting unit (6) includes a funnel-shaped web intake element (20).

14. A method of controling the fibre fluctuation of a textile fibre web (9) comprising the steps of processing fibre to form a fibre web (9), conveying the fibre web (9) between a fibre manipulating unit (2 and/or 5) and a drafting unit (6) at a machine operating speed, and varying the length of a portion of the fibre web (9) between the fibre manipulating unit (2 and/or 5) and the drafting unit (6) by moving the drafting unit (6) relative to the fibre manipulating unit (2 and/or 5) inversely proportional to the machine operating speed.

15. A method as defined in claim 14 wherein the length of the web portion between the fibre manipulating unit (2 and/or 5) and the drafting unit (6) can be varied during the operation of the textile machine (1A–1E).

* * * * *